US006243067B1

(12) United States Patent
Noguchi et al.

(10) Patent No.: US 6,243,067 B1
(45) Date of Patent: Jun. 5, 2001

(54) LIQUID CRYSTAL PROJECTOR

(75) Inventors: Toshiyuki Noguchi; Kazuo Mukai, both of Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 08/850,097

(22) Filed: May 1, 1997

(30) Foreign Application Priority Data

May 24, 1996 (JP) ..... 8-129531

(51) Int. Cl.[7] ..... G09G 3/36
(52) U.S. Cl. ..... 345/102; 345/88
(58) Field of Search ..... 345/87, 88, 30, 345/48; 359/558; 348/746; 353/84, 74, 102

(56) References Cited

U.S. PATENT DOCUMENTS

| | | | | |
|---|---|---|---|---|
| 4,739,396 | * | 4/1988 | Hyatt | 348/751 |
| 4,907,862 | * | 3/1990 | Suntola | 349/61 |
| 5,121,233 | * | 6/1992 | Spencer et al. | 349/69 |
| 5,337,068 | * | 8/1994 | Stewart et al. | 345/88 |
| 5,392,140 | * | 2/1995 | Ezra et al. | 349/15 |
| 5,491,525 | * | 2/1996 | Yamasaki et al. | 353/98 |
| 5,495,150 | * | 2/1996 | Zawislak et al. | 315/294 |
| 5,502,490 | * | 3/1996 | Takanashi et al. | 358/296 |
| 5,796,376 | * | 8/1998 | Banks | 345/82 |
| 5,798,864 | * | 8/1998 | Sekiguchi | 359/558 |

FOREIGN PATENT DOCUMENTS

| | | |
|---|---|---|
| 5-313115 | 11/1993 | (JP) . |
| 6-60833 | 8/1994 | (JP) . |

* cited by examiner

*Primary Examiner*—Steven Saras
*Assistant Examiner*—Fritz Alphonse
(74) *Attorney, Agent, or Firm*—McDermott, Will & Emery

(57) ABSTRACT

A liquid crystal projector that has a plurality of light sources for providing light to a light crystal panel, which functions as an image forming unit in the projector. A plurality of light source driving power sources are connected to the plural light sources individually by means of a light source lighting control circuit. As the light source lighting control circuit, a delay circuit, a counter circuit, or a programmed microcomputer is used. By controlling the light source driving power sources, each one of the plural light sources lights up sequentially or alternately in time. The light emitted from the light sources is modulated by the liquid crystal panel to produce a light image, and the light image is projected through the projector lens.

14 Claims, 7 Drawing Sheets

LIQUID CRYSTAL PROJECTOR

BACKGROUND OF THE INVENTION

The present invention relates to a liquid crystal projector having a light source, a liquid crystal panel, and a projector lens.

An example of a conventional liquid crystal projector is shown in FIG. 9 from Japanese Laid-open Patent Publication NO. 5-313115. FIG. 9 is a structural diagram depicting the basic concept of a liquid crystal projector. In FIG. 9, a power source 10 of a liquid crystal projector main body supplies electric power to a light source driving power source 20. The light source driving power source 20 converts the electric power supplied from the power source 10 into a state optimum for driving a light source 30, and supplies the electric power to the light source 30. As the light source 30, a halogen lamp or the like is used. A condenser lens 40 is used to condense the rays of light from the light 30, and to transform the rays into parallel light. The transformed rays of light are fed into a liquid crystal panel 50, which functions as an image forming unit to form an image. The image is later magnified by a projector lens 60, and a magnified image is projected on a screen 70.

In the conventional constitution, as shown in FIG. 9, since the light efficiency of the light source is extremely low, the image becomes dark when a large image is projected. Accordingly, by using a plurality of light sources, a method for producing a brightness sensation of a large image hag been proposed. However, the problem in this case is that the electric power consumed by one light source is as much as hundreds of watts. Therefore, when plural light sources are lit up or put out simultaneously, the stress to load fluctuations of the power source feeding electric power to the light sources is large, which may lead to breakdown of power source or the like.

SUMMARY OF THE INVENTION

The liquid crystal projector of the present invention comprises plural light sources, a liquid crystal panel for modulating the light emitted from the lighting light source out of the plural light sources, corresponding to image information, and a projector lens for projecting a light image modulated by the liquid crystal panel. Each one of the plural light sources emits light sequentially in time. The emitted light is modulated by the liquid crystal panel, and a light image is produced. The light image is projected by a projector lens. The liquid crystal panel is a valve for controlling the transmission of light.

With this arrangement, the fluctuation width of the load of the power source supplying electric power to the light source is decreased, the occurrence of troubles, such as a breakdown of the power source or light source is prevented, and a bright image is obtained.

In the present invention, preferably, when a switch of a power source is switched on, each one of the plural light sources starts emitting light sequentially delayed in time. Such a constitution has the advantage of a providing a bright image without fluctuations in power and breakdowns of the power and light sources.

The liquid crystal projector, according to the present invention further comprises, plural light-source-driving-power-sources connected to the plural light sources individually, and light-source-lighting-control-means for sending a light-source-lighting-control-signal to the plural light-source-driving-power-sources, whereby each one of the plural light sources lights up or emits light sequentially by means of the light-source-lighting-control-means.

Another liquid crystal projector, according to the present invention comprises, plural light sources, a liquid crystal panel for modulating the light emitted from the plural light sources corresponding to image information, and a projector lens for projecting a light image modulated by the liquid crystal panel. At least two of the plural light sources emits light alternately. This arrangement provides the advantage of improving the life of the light sources.

In the present invention, the light-source-lighting-control-means is a delay circuit, and each one of the plural light sources lights up sequentially by the delay circuit, which provides time controlled signals to each of the light-source-driving-power-sources.

As a variation, the light-source-lighting-control-means is a counter circuit that provides time controlled signals to each of the light-source-driving-power-sources.

In another variation, the light-source-lighting-control-means is a programmed microcomputer that provides time controlled signals to each of the light-source-driving-power-sources.

The present invention provides the advantages of decreasing the fluctuation width of the load of the power source for supplying electric power up to the light source, preventing the occurrence of troubles such as the breakdown of the power source or light source, and results in a bright image.

The invention itself, together with further objects and attendant advantages, will best be understood by reference to the following detailed description taken in conjunction with the accompanying figures.

DESCRIPTION OF THE PREFERRED EMBODIMENTS

Embodiment 1

Figure 1:
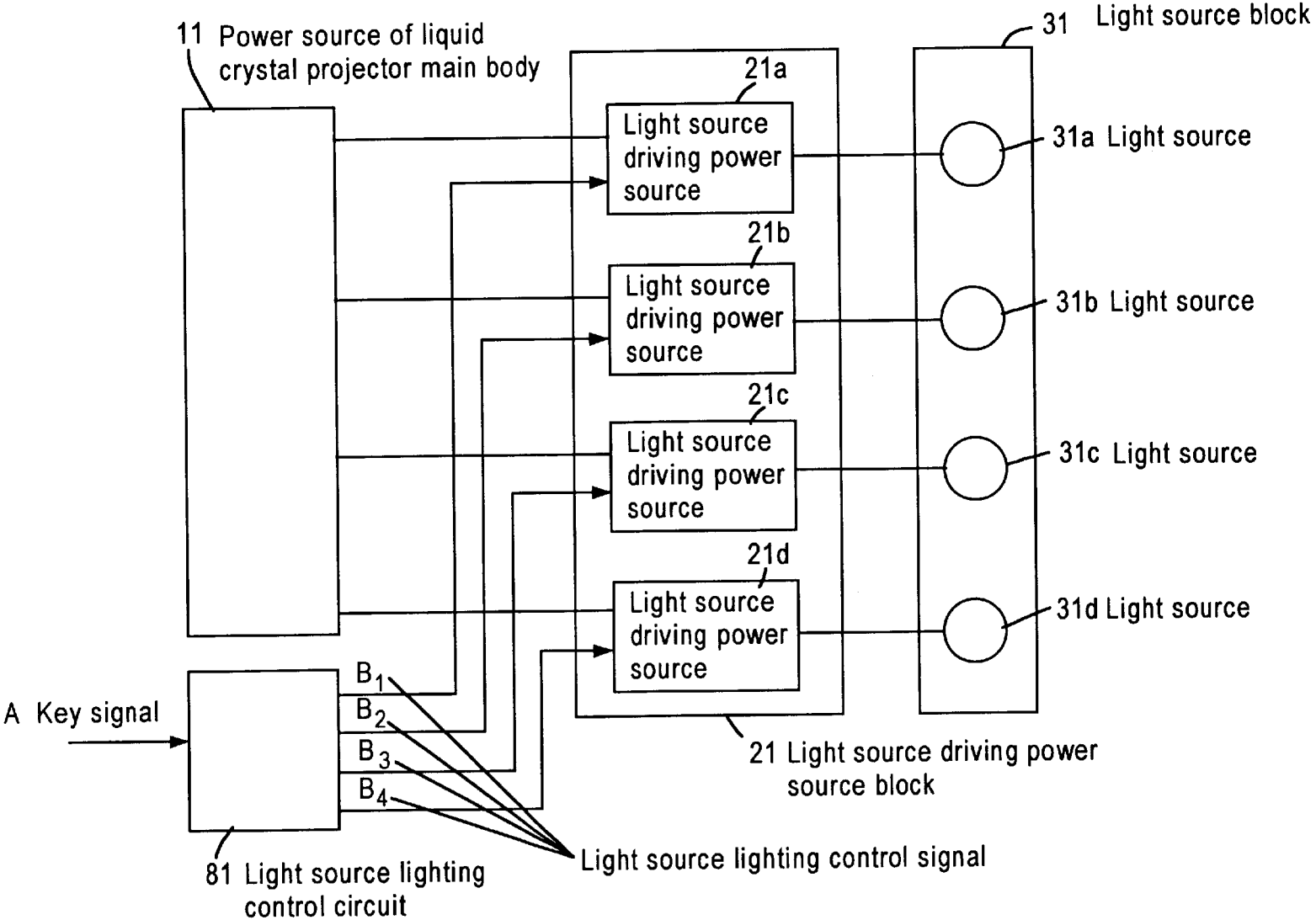
FIG. 1 is a block structural diagram of a liquid crystal projector of an embodiment of the invention.

FIG. 1 is a structural block diagram of a power source, light source and control circuit for a liquid crystal projector according to a first embodiment of the invention. In this embodiment the light source comprises a plurality of light sources.

In FIG. 1, a power source 11 of a liquid crystal projector main body supplies electric power to light source driving power source 21 comprising a plurality of sources a to d. As the light source 31, the same number of light sources a to d are provided as the number of light source driving power sources a to d. Each of the light source driving power sources a to d are individually connected to the light sources a to d, respectively. The light source driving power sources a to d transform the electric power supplied from the power source 11 of the liquid crystal projector main body into an optimum state for driving the light sources a to d. A light source lighting control circuit 81 is light source lighting control means used to control the light source driving power source 21. The supply of electric power to the light sources a to d is on/off controlled by light source lighting control signals $B_1$ to $B_4$, which are released from the light source lighting control circuit 81. Each of the light source lighting control signals $B_1$ to $B_4$ is connected to one of the corresponding light source driving power sources a to d, respectively.

Figure 5:
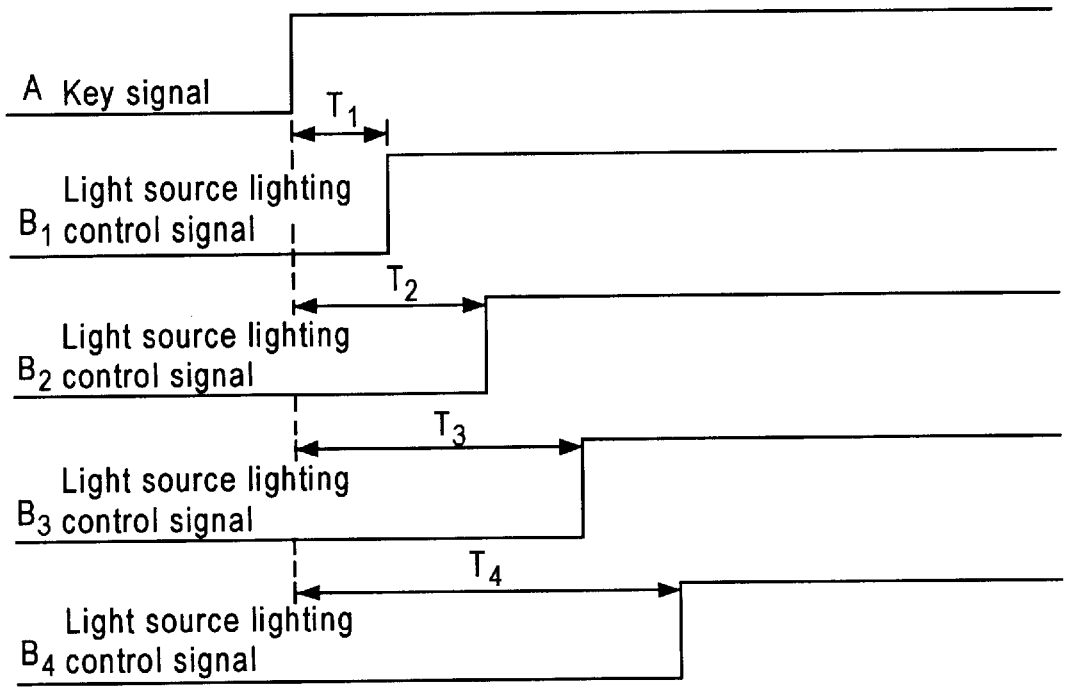
FIG. 5 is an example of a timing chart of a light source lighting control circuit shown in FIG. 2, FIG. 3, and FIG. 4

In particular, when a light source on/off signal (key signal A), which is generated by an external switch or the like, is fed into the light source lighting control circuit 81, the light source lighting control circuit 81 generates a light source lighting control signal $B_1$, delayed by $T_1$, from the key signal A, as shown in an example of a timing chart in FIG. 5. As further depicted in FIG. 5, the light source lighting control circuit 81 also generates a light source lighting control signal $B_2$ delayed by $T_2$ from the key signal A etc. In this way, the light source lighting control signals $B_1$ to $B_4$ are created on the basis of key signal A, and these signals are transmitted to the light source driving power sources a to d.

Figure 6:
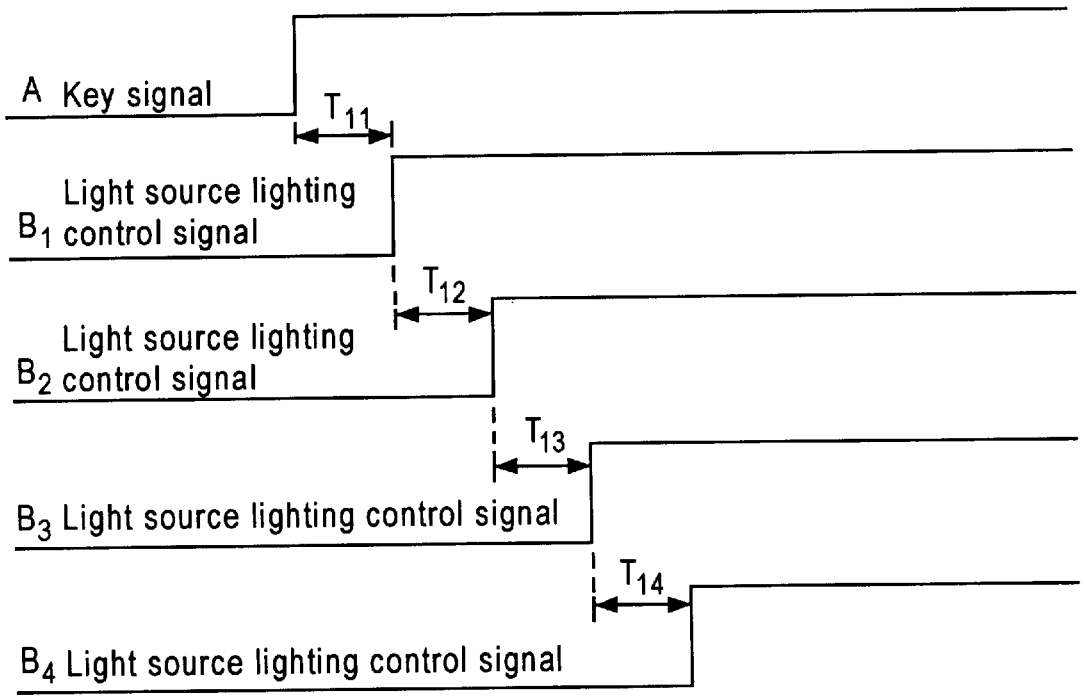
FIG. 6 is another example of a timing chart of a light source lighting control circuit shown in FIG. 2, FIG. 3, and FIG. 4.

The delay time $T_1$ to $T_4$ may be varied. As shown in FIG. 6, the light source lighting control circuit 81 may generate light source lighting control signal $B_1$ delayed by $T_{11}$ from a key signal A, and generate light source lighting control signal $B_2$ delayed by $T_{12}$ from light source lighting control signal $B_1$, and thereafter in the same manner, light source lighting control signals $B_3$, $B_4$ delayed by $T_{13}$, $T_{14}$ may be generated.

The delay time $T_1$ to $T_4$, $T_{11}$ to $T_{14}$ may be set freely depending on the requirement.

The light source driving power sources 21*a* to 21*d*, upon receiving the light source lighting control signals $B_1$, to $B_4$ sequentially, start to supply electric power to the light sources 31*a* to 31*d*. In this manner, a sequential lighting control of the light sources 31*a* to 31*d* is realized.

As a variation, five or more light sources may be used. With such an arrangement, each one of the plural light sources emits light sequentially in time.

A liquid crystal projector provided with power and light sources according to the first embodiment has the advantage of providing brighter images, reducing the load fluctuation width of the power source 11, and preventing breakdown and other troubles.

Embodiment 2

Figure 2:
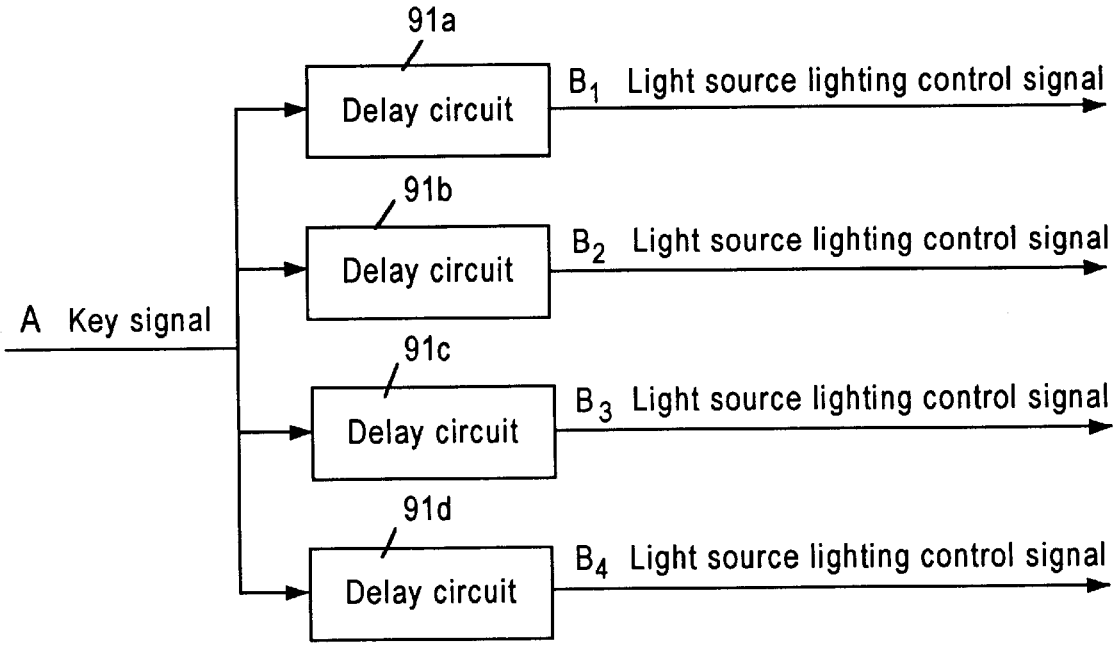
FIG. 2 is a structural diagram of a light source lighting control circuit in FIG. 1 using a delay circuit.

FIG. 2 shows a structural example of the light source lighting control circuit 81 in FIG. 1. As shown in FIG. 2, the delay circuits 91*a* to 91*d*, respectively, have circuit time constants $T_1$ to $T_4$. The light source lighting control signals $B_1$ to $B_4$ are generated by the delay circuits with the timing as shown in FIG. 5, or any other time setting, depending on the requirement.

In particular, with the arrangement shown in FIG. 5, a key signal A generated by an external switch or the like is simultaneously entered in the delay circuits 91*a* to 91*d*. The delay circuits 91*a* to 91*d* generate light source lighting control signals $B_1$ to $B_4$ so that the timing may be as shown in FIG. 5, and transmit the control signals to the light source driving power sources 21*a* to 21*d*. The light source driving power sources 21*a* to 21*d*, upon receiving the light source lighting control signals $B_1$ to $B_4$ sequentially start to supply electric power to the light sources 31*a* to 31*d*, so that a sequential control of the lighting of the light sources 31*a* to 31*d* is realized.

Hence, according to the present invention, the load fluctuation width of the power source 11 becomes smaller, and the breakdown of the power source 11 and other troubles can be prevented.

Embodiment 3

Figure 3:
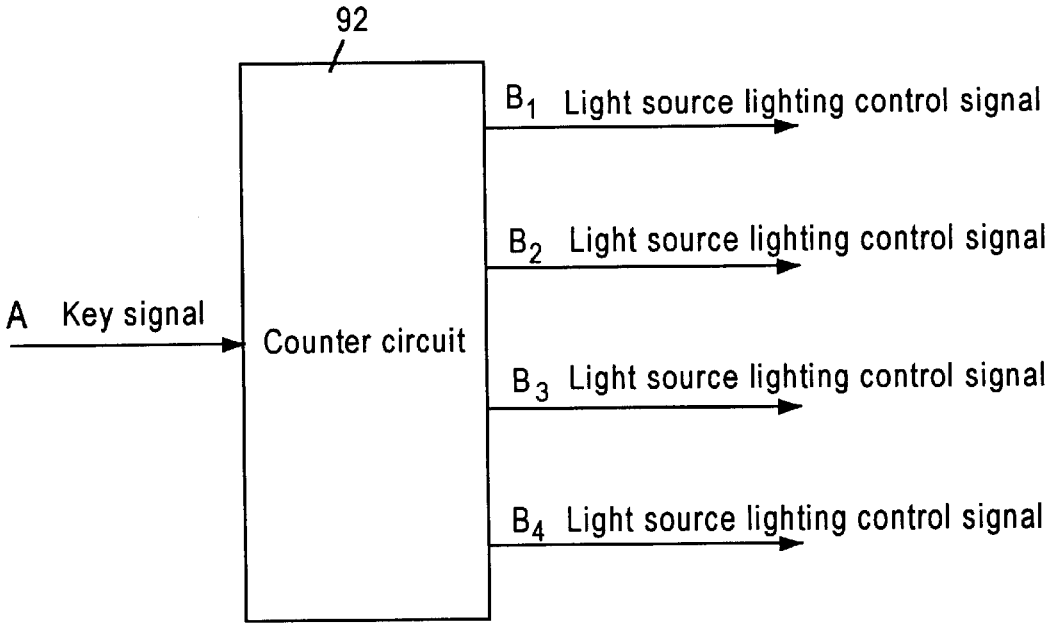
FIG. 3 is a structural diagram of a light source lighting control circuit in FIG. 1 using a counter circuit.

FIG. 3 is a structural example of the light source lighting control circuit 81 in FIG. 1 in the form of a counter circuit 92. As shown in FIG. 3, a counter circuit 92 may be employed as the control circuit and the time setting set depending on the application requirement. The light source lighting control signals $B_1$ to $B_4$ may be generated with the time settings shown in FIG. 5 or FIG. 6 with a counter circuit 92.

In this embodiment, a key signal A, which is generated by an external switch or the like, is applied to the counter circuit 92. The counter circuit 92 counts the time of $T_1$ to $T_4$, or $T_{11}$ to $T_{14}$, or any other time setting desired, so that the timing may be as shown in FIG. 5 or FIG. 6, and generates light source lighting control signals $B_1$ to $B_4$ that are transmitted to the light source driving power sources 21*a* to 21*d*.

The light source driving power sources 21*a* to 21*d*, upon receiving the light source lighting control signals $B_1$ to $B_4$, sequentially start to supply electric power to the light sources 31*a* to 31*d*, so that the light sources 31*a* to 31*d* are controlled sequentially.

Hence, the present invention provides the advantage of smaller load fluctuations of the power source 11, and in preventing the breakdown of the power source 11 and other troubles.

Embodiment 4

Figure 4:
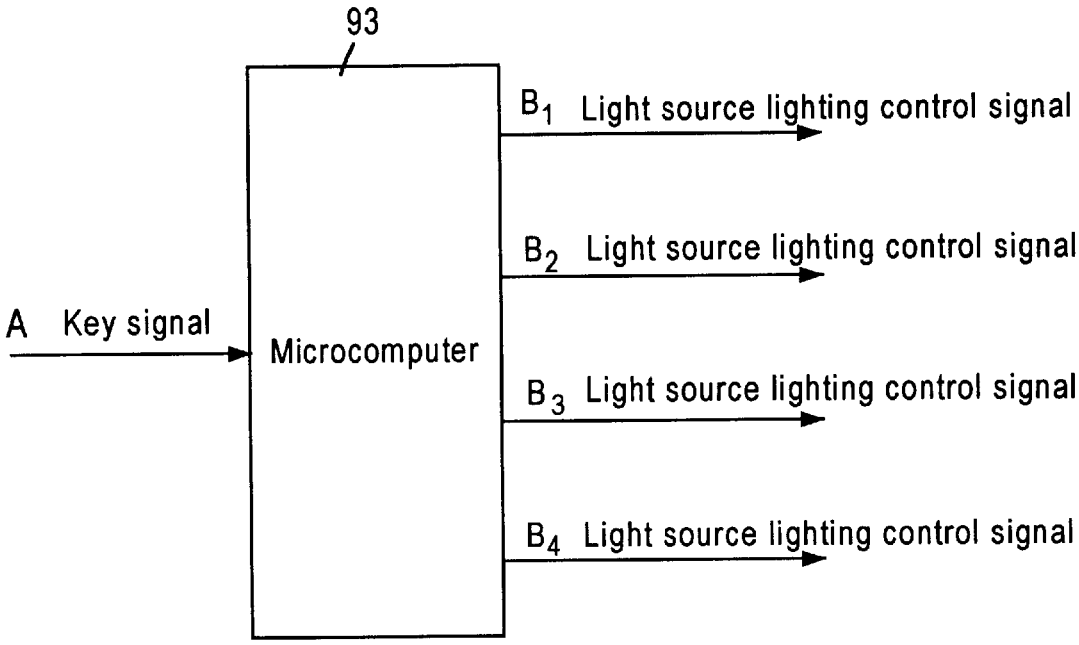
FIG. 4 is a structural diagram of the light source lighting control circuit in FIG. 1 using a microcomputer.
Figure 7:
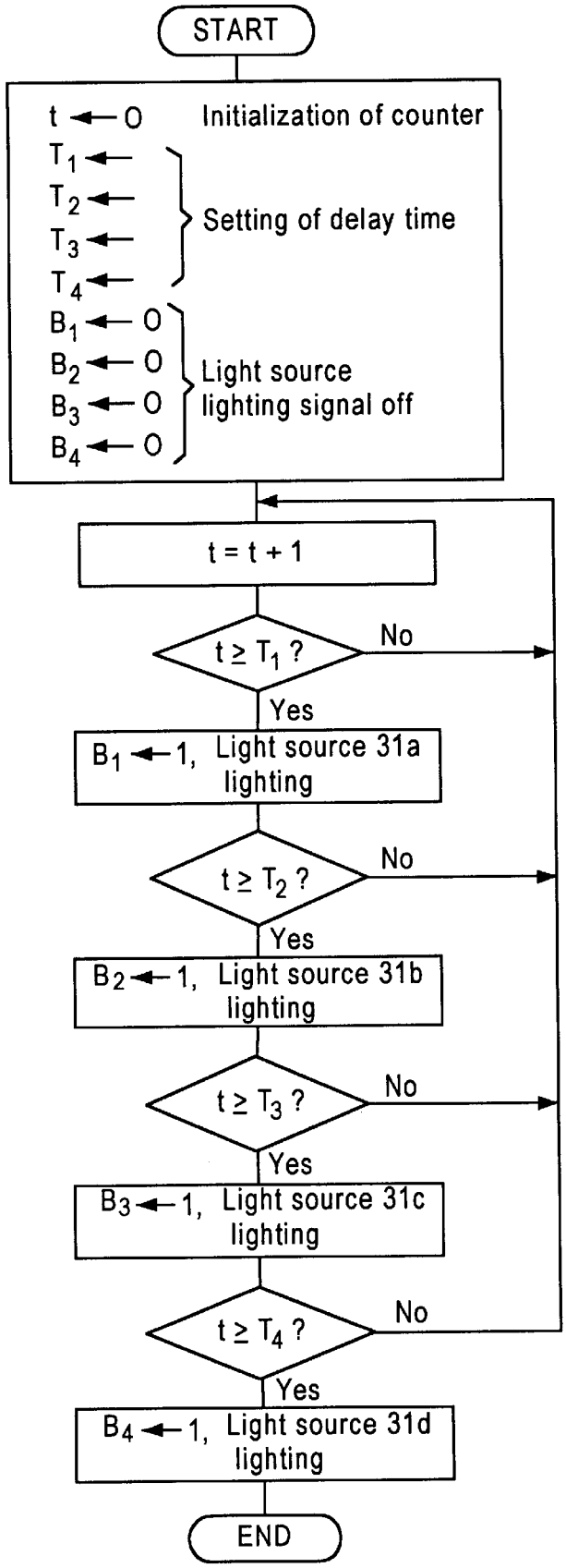
FIG. 7 shows an example of a flickered for the embodiment in FIG. 4 and FIG. 5.
Figure 8:
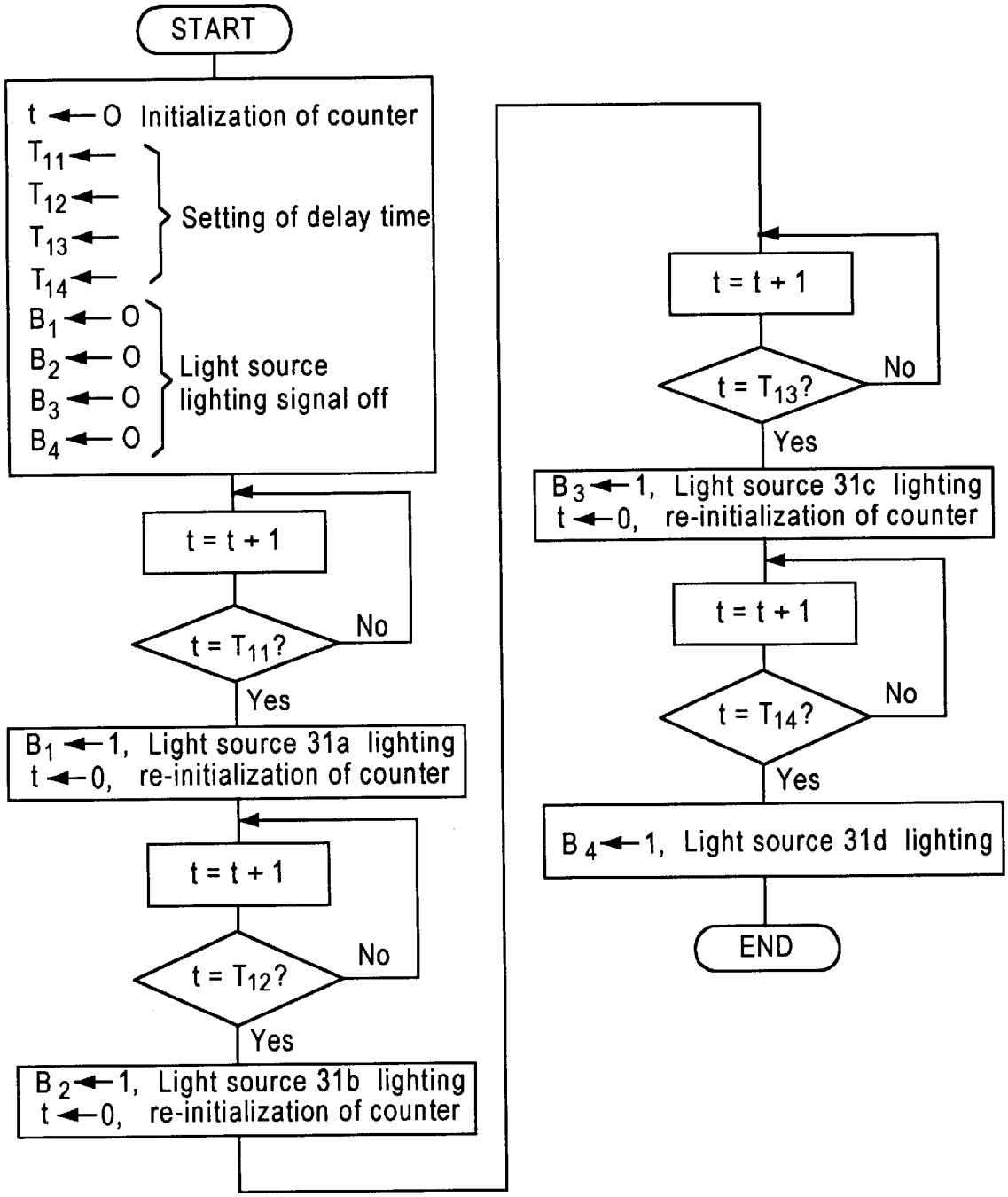
FIG. 8 shows an example of a flickered for the embodiment in FIG. 4 and FIG. 6.
Figure 9:
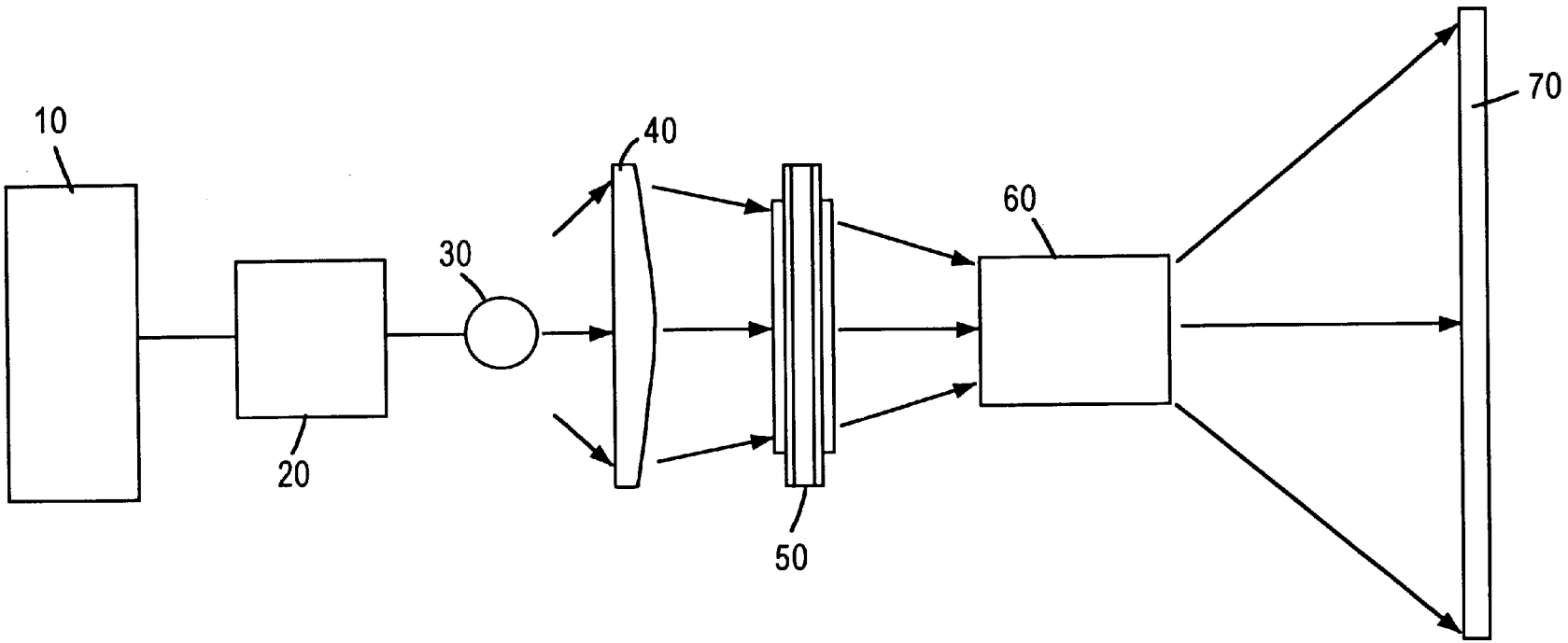
FIG. 9 PRIOR ART
FIG. 9 is a structural diagram of a conventional liquid crystal projector.

FIG. 4 depicts another variation for realizing the light source lighting control circuit 81 in FIG. 1. In this embodiment, a microcomputer 93 is used to generate the sequentially time delayed control signals. As shown in FIG. 4, when key signal A that is generated by an external switch or the like is fed into the microcomputer 93, the microcomputer 93 starts up a program according to an example of a flickered as clearly shown in FIG. 7 or FIG. 8. The microcomputer generates the light source lighting control signals $B_1$ to $B_4$ according to the timing shown in FIG. 5 or FIG. 6, and transmits the control signals in a sequential to the light source driving power sources 21*a* to 21*d*.

The light source driving power sources 21*a* to 21*d*, upon receiving the light source lighting control signals $B_1$ to $B_4$, sequentially start to supply electric power to the light sources 31*a* to 31*d*, in a time delayed sequential manner so that the light sources 31*a* to 31*d* are lit on/off in a sequential manner.

Hence, the load fluctuation width of the power source 11 becomes smaller, and the breakdown of the power source 11 and other troubles can be prevented.

In this way, the liquid crystal projector of the invention employs a plurality of light sources, which light up sequentially in order to obtain bright images.

According to the invention, when turning on and off a plurality of power sources, the load fluctuation width of the power source 11 becomes smaller, and a breakdown of the power source 11 and other troubles can be prevented.

Embodiment 5

A fifth embodiment is a variation of Embodiment 1. In the fifth embodiment, the light source block 31 comprises: (i) a first group of light sources including the first light source

31*a* and the second light source 31*b;* and (ii) a second group of light sources including the third light source 31*c* and the fourth light source 31*d*. The light source lighting control circuit functions to control the first and second groups of light sources alternately. In particular, when the first group of light sources 31*a*, 31*b* is emitting light, the second group of light sources 31*c*, 31*d* is not emitting light. With this arrangement, an improvement in the life of the light sources is obtained.

Of course, it should be understood that a wide range of changes and modifications can be made to the preferred embodiment described above and that the foregoing description be regarded as illustrative rather than limiting. It is therefore intended that it is the following claims, including all equivalents, which are intended to define the scope of this invention.

What is claimed is:

1. A liquid crystal projector comprising:

plural light sources, each of said plural light sources for emitting light during a first and second period of time, wherein during said first period of time each of said plural light sources emitting light sequentially beginning with a first light source such that each light source except for said first light source emits light when the previous light source to emit light is adjacent to said each light source, and during said second period of time each of said plural light sources emitting light simultaneously;

a liquid crystal panel for modulating the light emitted from said plural light sources, corresponding to image information; and a projector lens for projecting a light image modulated by said liquid crystal panel.

2. A liquid crystal projector of claim 1, wherein said each of said plural light sources starts to emit light sequentially delayed in time when an external switch is thrown.

3. A liquid crystal projector of claim 1, further comprising:

a delay circuit for controlling the emitting of light of said each of said plural light sources, wherein each of said plural light sources starts to emit light sequentially in time by a control of said delay circuit.

4. A liquid crystal projector of claim 1, further comprising:

a counter circuit for controlling the emitting of light of each of said plural light sources, wherein said each of said plural light sources emits light sequentially by a control of said counter circuit.

5. A liquid crystal projector of claim 1, further comprising:

a programmed microcomputer for controlling the emitting of light of each of said plural light sources, wherein each of said plural light sources emits light sequentially by a control of said microcomputer.

6. A liquid crystal projector comprising:

plural light sources for emitting light during a first and second period of time, a liquid crystal panel for modulating the light emitted from at least one of said plural light sources, corresponding to image information, a projector lens for projecting a light image modulated by said liquid crystal panel, plural light-source-driving-power-sources connected to said plural light sources individually, and light-source-lighting-control-means for sending a signal to said plural light-source-driving-power-sources to control a lighting of said plural light sources, wherein each of said plural light sources emits light sequentially in said first period of time beginning with a first light source such that each light source except for said first light source emits light when the previous light source to emit light is adjacent to said each light source, and each of said plural light sources emits light simultaneously in said second period of time.

7. A liquid crystal projector of claim 6, wherein said light-source-lighting-control-means sends a light-source-lighting-control-signal to each of said plural light-source-driving-power-sources on a basis of an on/off signal of a power source, wherein each of said plural light sources lights up sequentially in time by a supply of electric power from said light-source-driving-power-source on a basis of said light-source-lighting-control-signal, wherein the light emitted from a light source is modulated by said liquid crystal panel to produce said light image, and wherein said light image is projected through said projector lens.

8. A liquid crystal projector of claim 6, wherein said light-source-lighting-control-means has a delay circuit, and wherein each of said plural sources emits light sequentially by a control of said delay circuit.

9. A liquid crystal projector of claim 6, wherein said light-source-lighting-control-means has a counter circuit, and wherein each of said plural light sources emits light sequentially by a control of said counter circuit.

10. A liquid crystal projector of claim 6, wherein said light-source-lighting-control-means has a programmed microcomputer, and said each of said plural light sources emits light sequentially by a control of said microcomputer.

11. A method of providing power to a light source, comprising the steps of:

providing a plurality of light sources for emitting light during a first and second period of time, driving each light source with an individual light source driving power source, and controlling each light source driving power source wherein each of the plurality of light sources emits light alternatively in said first period of time beginning with a first light source such that each light source except for said first light source emits light when the previous light source to emit light is adjacent to said each light source, and each of the plurality of light sources emits light simultaneously in said second period of time.

12. The method of claim 11, further comprising the step of:

modulating the light emitted from each one of the light sources, and projecting the modulated light.

13. A liquid crystal projector comprising:

plural light sources, at least two of said plural light sources for emitting light during a first and second period of time, said at least two of said plural light sources for emitting light alternatively in said first period of time beginning with a first light source such that each light source except for said first light source emits light when the previous light source to emit light is adjacent to said each light source, and said at least two of said plural light sources for emitting light simultaneously in said second period of time;

a liquid crystal panel for modulating the light emitted from said plural light sources, corresponding to image information; and a projector lens for projecting a light image modulated by said liquid crystal panel.

14. A liquid crystal projector of claim 13, further comprising:

a programmed microcomputer for controlling the emitting of light of the plural light sources, wherein said at least two plural light sources emit light alternately by a control of said microcomputer.

* * * * *